US008500294B2

(12) United States Patent
Bosnjak et al.

(10) Patent No.: US 8,500,294 B2
(45) Date of Patent: Aug. 6, 2013

(54) LIGHT HAVING AT LEAST ONE LED

(75) Inventors: Zoran Bosnjak, Munich (DE); Jeanine Chrobak-Kando, Appenweier (DE); Harald Dellian, Edling (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 574 days.

(21) Appl. No.: 12/672,701

(22) PCT Filed: Aug. 10, 2007

(86) PCT No.: PCT/EP2007/058292

§ 371 (c)(1),
(2), (4) Date: Feb. 9, 2010

(87) PCT Pub. No.: WO2009/021543

PCT Pub. Date: Feb. 19, 2009

(65) Prior Publication Data

US 2012/0007509 A1 Jan. 12, 2012

(51) Int. Cl.
*F21L 4/00* (2006.01)
*F21V 21/00* (2006.01)

(52) U.S. Cl.
USPC ..... 362/157; 362/249.1; 315/71

(58) Field of Classification Search
USPC ..... 315/71; 362/157, 249.01, 249.07–249.1
See application file for complete search history.

(56) References Cited

U.S. PATENT DOCUMENTS

| | | | | |
|---|---|---|---|---|
| 5,738,432 | A | 4/1998 | Okko et al. | |
| 6,820,999 | B2 | 11/2004 | Kotovsky et al. | |
| 7,396,140 | B2 * | 7/2008 | Cai | 362/167 |
| 7,789,524 | B2 * | 9/2010 | Anderson | 362/183 |
| 2005/0103378 | A1 * | 5/2005 | Pu et al. | 136/291 |
| 2008/0129543 | A1 * | 6/2008 | Lee | 340/908 |
| 2008/0273320 | A1 * | 11/2008 | Ko | 362/183 |

FOREIGN PATENT DOCUMENTS

| | | | |
|---|---|---|---|
| CN | 1459582 | A | 12/2003 |
| CN | 200958702 | Y | 10/2007 |
| DE | 8205017.1 | U1 | 7/1982 |
| DE | 4440352 | A1 | 5/1998 |
| DE | 10336543 | A1 | 3/2005 |
| EP | 1178261 | A2 | 2/2002 |
| JP | 2002094129 | A | 3/2002 |

OTHER PUBLICATIONS

International Search Report of PCT/EP2007/058292.
English language abstract of DE 4440352 A1.
English language abstract of DE 10336543 A1.
English language abstract of EP 1178261 A2.
English translation of G 8205017.1 U1.
English language abstract of JP 2002-094129 A.
English language abstract for CN 200958702 Y.
Chinese Office Action dated Nov. 1, 2010.

* cited by examiner

*Primary Examiner* — Don Le

(57) ABSTRACT

A luminaire may include at least one LED; a solar module; an accumulator; an electronic charger coupled between the solar module and the accumulator; and a drive circuit coupled to the accumulator, for the at least one LED; a fastening device that is configured to fasten the luminaire at an operating location; and an LED holding device that is configured to hold the at least one LED; wherein the luminaire may further include a position varying device that is coupled between the fastening device and the LED holding device and is configured to vary the position of the at least one LED in relation to the fastening device.

15 Claims, 2 Drawing Sheets

LIGHT HAVING AT LEAST ONE LED

RELATED APPLICATIONS

The present application is a national stage entry according to 35 U.S.C. §371 of PCT application No. PCT/EP2007/058292 filed on Aug. 10, 2007.

TECHNICAL FIELD

Various embodiments relate to a luminaire having at least one LED, a solar module, an accumulator, an electronic charger coupled between the solar module and the accumulator, and a drive circuit coupled to the accumulator, for the at least one LED, a fastening device that is configured to fasten the luminaire at an operating location, and an LED holding device that is configured to hold the at least one LED.

BACKGROUND

Known from the prior art are generic luminaires having at least one LED that are, for example, used to mark paths, as floating luminaires and as garden luminaires. In this case, the LED holding device is configured in one piece with the fastening device or is connected thereto in a fixed position.

SUMMARY

Various embodiments develop a generic luminaire in such a way that further options for use are opened up thereby.

Various embodiments are based on the finding that this can be achieved when there is coupled between the fastening device and the LED holding device a position varying device that is configured to vary the position of the at least one LED in relation to the fastening device. It is thereby possible, for example, to even out drilling inaccuracies when a plurality of inventive luminaires are wall mounted, in order to enable a cooperation of the multiplicity of luminaires for the display of patterns, plays of color or documents. Since each luminaire has a separate fastening device, mounting inaccuracies that disrupt the overall impression can be corrected by expanding around an inventive position varying device.

It is preferred for the position varying device to be configured to undertake a translational and/or a rotational variation in the position of the at least one LED in relation to the fastening device. Consequently, it is possible to correct the position of the at least one LED in all directions in a plane.

The luminaire preferably further has a receiver that is coupled to the accumulator and is configured to receive a radio signal, and a processing device that is coupled to the accumulator and the receiver and is configured to form at least one drive signal for the drive circuit from the data received with the radio signal. As a result, it becomes possible to drive an inventive luminaire by radio, for example for the purpose of switching the at least one LED on and off.

In accordance with one preferred embodiment, the position varying device has a first element that is coupled to the fastening device, and a second element that is coupled to the LED holding device. In this case, the first element preferably has a splined shaft profile, and the second element has a splined hub profile, or vice versa. Furthermore, it is preferred when the splined shaft profile constitutes a toothed wheel and the splined hub profile constitutes a gear ring.

It can be provided that the first element and the second element are configured to be assembled by a user at different relative positions from one another. A user can therefore undertake to position the at least one LED in relation to the fastening device. It is particularly preferred, however, when the luminaire further has an electric motor, preferably a stepping motor, that is coupled to the accumulator and is configured to vary the position of the first element in relation to the second element, or vice versa. It is particularly preferred for the luminaire to include a microcontroller which is coupled to the receiver and enables the electric motor to be driven by a radio signal.

In accordance with one preferred development, the luminaire further has an anti-theft protection that is configured to fix the first element and the second element in a mutually connected state, the anti-theft protection including an actuating device for detaching and attaching the anti-theft protection, which can be operated via a tool that is specific to a stipulated anti-theft protection, in particular is unique. It is thereby possible to attach a multiplicity of inventive luminaires in the open without having to worry about them being taken without permission.

It can be possible to rotate the first element in relation to the second element via a rotational axis, it being possible for the at least one LED to be positioned centrally or eccentrically in relation to the rotational axis.

In order to produce interesting optical phenomena, the second element and/or the LED holding device can have at least one wind wheel. Particularly in conjunction with a previously mentioned eccentric mounting of the at least one LED in relation to a rotational axis, it is possible thereby to produce interesting, novel effects.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
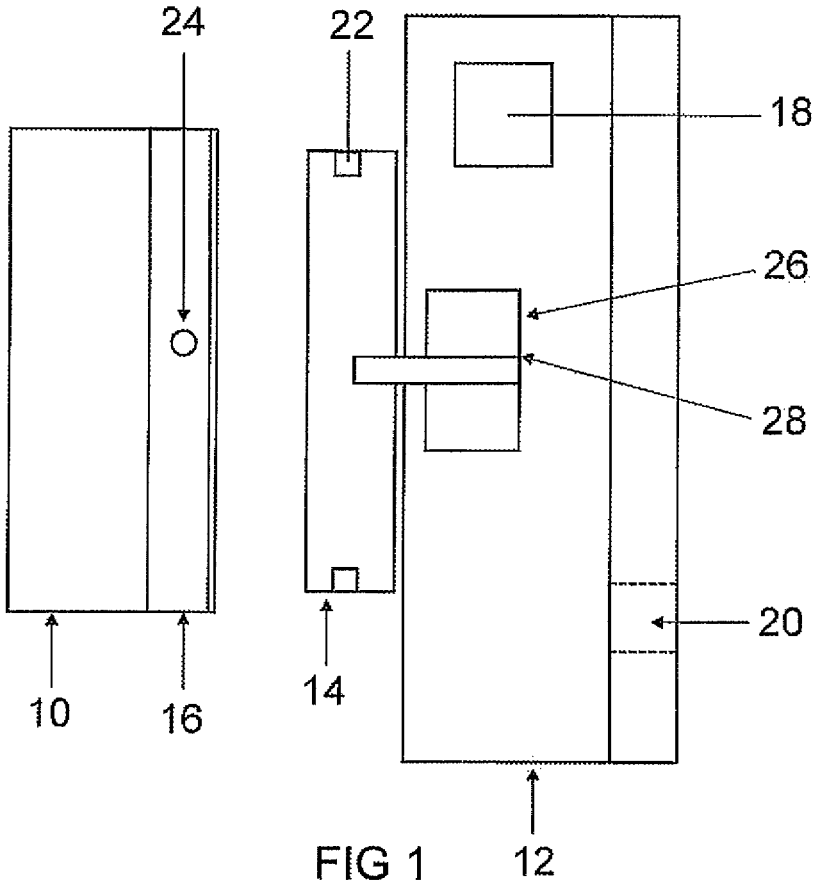
FIG. 1 is a schematic side view of an inventive luminaire.

FIG. 1 is a schematic side view of the design of an inventive luminaire. The latter has a fastening device 10 and an LED holding device 12 that are coupled via a position varying device. The fastening device 10 can be configured such that it can be fastened on a provided base by screws, a velcro-type tape, a magnet plate or the like. The position varying device has a toothed wheel 14 that is connected to the LED holding device 12, as well as a gear ring 16 that is connected to the fastening device 10. The reference numeral 18 marks a block in which different elements of an inventive luminaire are assembled schematically, in particular a solar module, an accumulator, an electronic charger coupled between the solar module and the accumulator, and a drive circuit, coupled to the accumulator, for the at least one LED 20. Provided peripherally in the toothed wheel 14 is a groove 22 into which a grub screw can be turned via an opening 24 in the gear ring 16 for the purpose of anti-theft protection. More details on this point are set forth below with reference to FIG. 3. Provided inside the LED holding device is a stepping motor 26 that enables a rotation of the LED holding device 12 about an axis 28, and thus a rotation of the LED 20 relative to the fastening device 10. The electric motor 26 can be activated by radio signal via a receiver that is further provided in block 18, is coupled to the accumulator and is configured to receive a radio signal. Moreover, in an embodiment not illustrated one gearing or gear racks can be used to undertake a translational variation of the position of the at least one LED 20 in relation to the fastening device 10.

Figure 2:
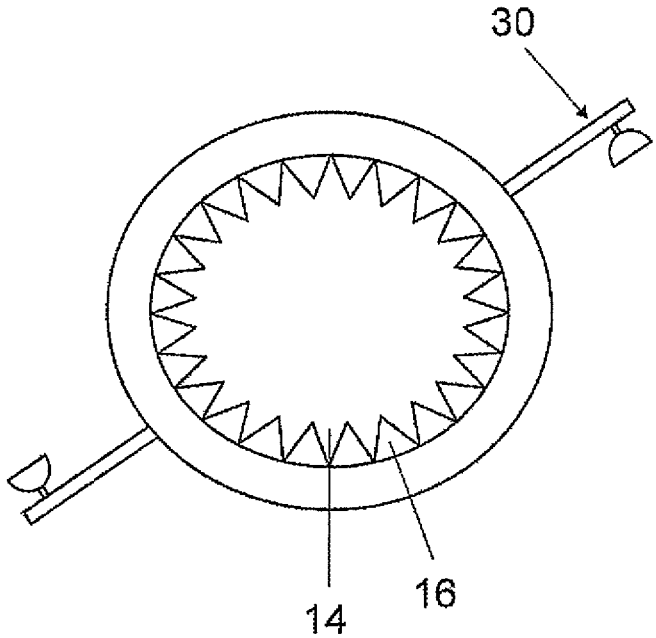
FIG. 2 shows a cross section through an inventive luminaire in the case of which the LED holding device is fixed in the fastening device.

FIG. 2 shows an alternative embodiment in the case of which the LED holding device 12 is rotated in relation to the fastening device 10 by means of wind wheels 30 attached to the LED holding device. Such a luminaire can be implemented with or without an electric motor 26.

Figure 3:
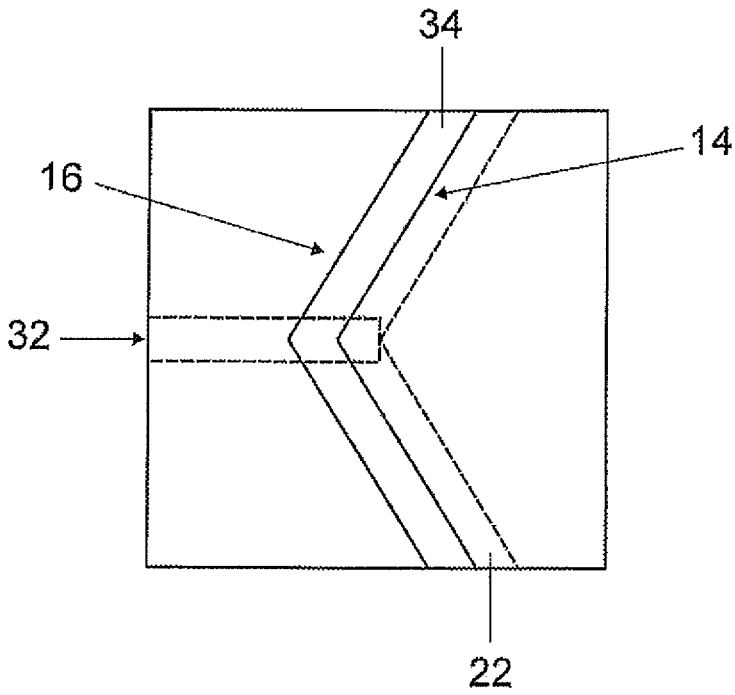
FIG. 3 shows an enlarged illustration of a segment of an LED holding device mounted on the fastening device, an anti-theft protection being used.

FIG. 3 is an enlarged schematic of the mode of operation of the anti-theft protection that enables an inventive luminaire to be protected against theft. To this end, a grub screw 32 is turned in through the opening 24 in the gear ring 16 and secures the connection between toothed wheel 14 and gear ring 16 after passing through an air gap 34 (depicted in an enlarged fashion). The end of the grub screw 32 via which it can be screwed in and out is preferably configured in such a way that it can be operated only by a special tool that is specific to a stipulated grub screw, in particular is unique.

Figure 4:
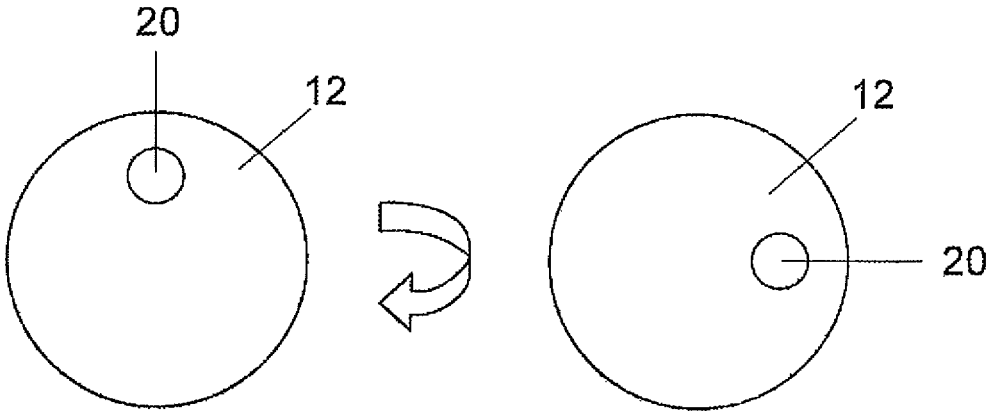
FIG. 4 shows a plan view from the right of the inventive luminaire illustrated in FIG. 1, in two different rotational positions.

FIG. 4 shows, by way of example, how the position of the LED 20 varies by rotation of the LED holding device 12 about the fastening device 10.

Instead of initiating a rotation via radio signal and the electric motor 26, it is directly possible in the case of one embodiment without electric motor for the toothed wheel 14 to be plugged in a desired position through the gear ring 16 and fixed there by means of the anti-theft protection 32.

The electronics in block 18 can be configured to receive via a radio signal a succession of light sequences and associated positions of the LED 20, to store this in a storage device, and to execute it in response to a specific signal.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A luminaire comprising:

at least one LED;

a solar module;

an accumulator;

an electronic charger coupled between the solar module and the accumulator; and a drive circuit coupled to the accumulator, for the at least one LED;

a fastening device that is configured to fasten the luminaire at an operating location; and an LED holding device that is configured to hold the at least one LED;

wherein the luminaire further comprises:

a position varying device that is coupled between the fastening device and the LED holding device and is configured to vary the position of the at least one LED in relation to the fastening device, the position varying device comprising a first element that is coupled to the fastening device, and a second element that is coupled to the LED holding device, and wherein the luminaire further has an electric motor that is coupled to the accumulator and is configured to vary the position of the first element in relation to the second element.

2. The luminaire as claimed in claim 1, wherein the position varying device is configured to undertake at least one of a translational and a rotational variation in the position of the at least one LED in relation to the fastening device.

3. The luminaire as claimed in claim 1, wherein the luminaire further comprises:

a receiver that is coupled to the accumulator and is configured to receive a radio signal; and a processing device that is coupled to the accumulator and the receiver and is configured to form at least one drive signal for the drive circuit from the data received with the radio signal.

4. The luminaire as claimed in claim 1, wherein the first element has a splined shaft profile, and the second element has a splined hub profile.

5. The luminaire as claimed in claim 4, wherein the splined shaft profile constitutes a toothed wheel and the splined hub profile constitutes a gear ring.

6. The luminaire as claimed in claim 1, wherein the first element and the second element are configured to be assembled by a user at different relative positions from one another.

7. The luminaire as claimed in claim 1, wherein the luminaire further comprises an anti-theft protection that is configured to fix the first element and the second element in a mutually connected state, the anti-theft protection comprising an actuating device for detaching and attaching the anti-theft protection, which can be operated via a tool that is specific to a stipulated anti-theft protection.

8. The luminaire as claimed in claim 1, wherein the first element can be rotated in relation to the second element via a rotational axis, the at least one LED being positioned centrally in relation to the rotational axis.

9. The luminaire as claimed in claim 1, wherein at least one of the second element and the LED holding device has at least one wind wheel.

10. The luminaire as claimed in claim 1, wherein the luminaire further has an electric motor that is coupled to the accumulator and is configured to vary the position of the second element in relation to the first element.

11. A luminaire comprising:

at least one LED;

a solar module;

an accumulator;

an electronic charger coupled between the solar module and the accumulator; and a drive circuit coupled to the accumulator, for the at least one LED;

a fastening device that is configured to fasten the luminaire at an operating location; and an LED holding device that is configured to hold the at least one LED;

wherein the luminaire further comprises:

a position varying device that is coupled between the fastening device and the LED holding device and is configured to vary the position of the at least one LED in relation to the fastening device;

a receiver that is coupled to the accumulator and is configured to receive a radio signal; and a processing device that is coupled to the accumulator and the receiver and is configured to form at least one drive signal for the drive circuit from the data received with the radio signal.

12. A luminaire comprising:

at least one LED;

a solar module;

an accumulator;

an electronic charger coupled between the solar module and the accumulator; and a drive circuit coupled to the accumulator, for the at least one LED;

a fastening device that is configured to fasten the luminaire at an operating location; and an LED holding device that is configured to hold the at least one LED;

wherein the luminaire further comprises:

a position varying device that is coupled between the fastening device and the LED holding device and is configured to vary the position of the at least one LED in relation to the fastening device, the position varying device comprising a first element that is coupled to the fastening device, and a second element that is coupled to the LED holding device, and wherein the first element has a splined shaft profile, and the second element has a splined hub profile.

13. The luminaire as claimed in claim 12, wherein the luminaire further comprises an anti-theft protection that is configured to fix the first element and the second element in a mutually connected state, the anti-theft protection comprising an actuating device for detaching and attaching the anti-theft protection, which can be operated via a tool that is specific to a stipulated anti-theft protection.

14. The luminaire as claimed in claim 12, wherein at least one of the second element and the LED holding device has at least one wind wheel.

15. The luminaire as claimed in claim 12, wherein the luminaire further has an electric motor that is coupled to the accumulator and is configured to vary the position of the second element in relation to the first element.

* * * * *